US012667767B2

(12) United States Patent
Masiukiewicz et al.

(10) Patent No.: US 12,667,767 B2
(45) Date of Patent: Jun. 30, 2026

(54) AUTOMATIC BALL MACHINE APPARATUS UTILIZING PLAYER IDENTIFICATION AND PLAYER TRACKING

(71) Applicant: Volley LLC, Lancaster, PA (US)

(72) Inventors: Lukasz Masiukiewicz, York, PA (US); Christopher Decker, Papillion, NE (US); Stephen Titus, Herndon, VA (US); John Weinlader, Wilmette, IL (US); Daniel Weinlader, Lititiz, PA (US)

(73) Assignee: Volley LLC, Lancaster, PA (US)

( * ) Notice: Subject to any disclaimer, the term of this patent is extended or adjusted under 35 U.S.C. 154(b) by 604 days.

(21) Appl. No.: 18/198,167

(22) Filed: May 16, 2023

(65) Prior Publication Data

US 2023/0285832 A1 Sep. 14, 2023

Related U.S. Application Data

(63) Continuation-in-part of application No. 18/097,345, filed on Jan. 16, 2023, which is a continuation-in-part (Continued)

(51) Int. Cl.
*A63B 69/40* (2006.01)
*A63B 71/06* (2006.01)

(52) U.S. Cl.
CPC ..... *A63B 69/406* (2013.01); *A63B 71/0622* (2013.01); *A63B 2069/402* (2013.01);

(Continued)

(58) Field of Classification Search
CPC ..... A63B 69/406; A63B 2069/402; A63B 2220/05; A63B 2220/13; A63B 2225/093;

(Continued)

(56) References Cited

U.S. PATENT DOCUMENTS 5,816,953 A 10/1998 Cleveland
6,539,931 B2 4/2003 Trajkovic et al.

(Continued)

FOREIGN PATENT DOCUMENTS

CN 107537149 A 1/2018
CN 110538443 A 12/2019

(Continued)

OTHER PUBLICATIONS

Translation of KR 102031894 B1 (Year: 2019).*

(Continued)

*Primary Examiner* — Jeffrey S Vanderveen
(74) *Attorney, Agent, or Firm* — Muir Patent Law, PLLC

(57) ABSTRACT

A ball machine comprising an imaging system to capture image data and a processor configured to, for a frame of the image data, analyze the image data using a neural network to detect a plurality of persons, determine a coordinate position on a playing surface of each of the plurality of detected persons, extract features of each of the plurality of detected persons, generate a first set of feature vectors corresponding to the plurality of detected persons, associate a first feature vector to the coordinate position on the playing surface of a first detected person to generate a first unique identifier, associate a second feature vector to the coordinate position on the playing surface of a second detected person to generate a second unique identifier, and control the ball machine to launch balls based on first settings corresponding to the first unique identifier and second settings corresponding to the second unique identifier.

20 Claims, 9 Drawing Sheets

Related U.S. Application Data of application No. 17/408,147, filed on Aug. 20, 2021, now Pat. No. 12,194,342, which is a continuation-in-part of application No. 17/093,321, filed on Nov. 9, 2020, now abandoned.

(52) U.S. Cl.
CPC ... *A63B 2071/0627* (2013.01); *A63B 2214/00* (2020.08); *A63B 2220/05* (2013.01); *A63B 2220/13* (2013.01); *A63B 2220/806* (2013.01); *A63B 2225/50* (2013.01); *A63B 2230/625* (2013.01)

(58) Field of Classification Search
CPC ..... A63B 2024/0025; A63B 2071/068; A63B 2220/30; A63B 2220/806; A63B 2220/808; A63B 2220/89; A63B 2225/20; A63B 2225/50; A63B 71/0619; A63B 24/0021; G06V 20/42
See application file for complete search history.

(56) References Cited

U.S. PATENT DOCUMENTS

| | | | | |
|---|---|---|---|---|
| 8,419,560 | B2 | 4/2013 | Amini | |
| 9,233,294 | B1 | 1/2016 | Coyle | |
| 10,695,644 | B2 | 6/2020 | Khazanov et al. | |
| 11,033,780 | B2 | 6/2021 | New et al. | |
| 11,367,364 | B2 | 6/2022 | May | |
| 11,657,906 | B2 | 5/2023 | Lewis et al. | |
| 2002/0148455 | A1* | 10/2002 | Trajkovic | A63B 65/12 124/78 |
| 2013/0130845 | A1 | 5/2013 | Marty | |
| 2014/0121043 | A1 | 5/2014 | Blanning | |
| 2015/0165300 | A1 | 6/2015 | Vaught et al. | |
| 2016/0310817 | A1 | 10/2016 | Yeager | |
| 2018/0140917 | A1 | 5/2018 | Song | |
| 2019/0087661 | A1* | 3/2019 | Lee | G06T 7/20 |
| 2019/0126120 | A1 | 5/2019 | Paredes et al. | |
| 2019/0240558 | A1 | 8/2019 | Khazanov | |
| 2020/0197782 | A1 | 6/2020 | Abdelmoneum | |
| 2020/0398139 | A1 | 12/2020 | Harley | |
| 2021/0031081 | A1 | 2/2021 | Lewis | |
| 2021/0064880 | A1* | 3/2021 | Zhang | G06T 7/90 |
| 2021/0128989 | A1 | 5/2021 | Legg et al. | |
| 2021/0354021 | A1 | 11/2021 | Hannallah | |
| 2021/0379446 | A1 | 12/2021 | Weinlader | |
| 2022/0198368 | A1 | 6/2022 | May | |
| 2022/0233942 | A1 | 7/2022 | Ferrabee | |
| 2023/0372803 | A1* | 11/2023 | Kweon | A63B 71/0669 |
| 2024/0152759 | A1 | 5/2024 | Rapp | |

FOREIGN PATENT DOCUMENTS

| | | | | |
|---|---|---|---|---|
| KR | 20190031113 | A | 3/2019 | |
| KR | 102031894 | B1 * | 11/2019 | A63B 24/0006 |
| KR | 102265914 | | 6/2021 | |
| KR | 102265914 | B1 | 6/2021 | |
| WO | 2022038587 | A1 | 2/2022 | |
| WO | 2022050792 | A1 | 3/2022 | |

OTHER PUBLICATIONS

POP Tennis How to Play and Court and Equipment Guide, International POP Tennis Association, Inc., https://www.poptennis.com, accessed Sep. 2022.
2022 Official International Federation of Pickleball Rulebook, International Federation of Pickleball, Revised 2022.
Regulations of the Padel Game, International Padel Federation, May 28, 2021.
2022 International Tennis Federation Rules of Tennis, International Tennis Federation, 2021.
Official Rules of Platform Tennis, American Platform Tennis Association, www.platformtennis.org/about_us/Rules_of_Platform_Tennis.htm, accessed Sep. 2022.

* cited by examiner

AUTOMATIC BALL MACHINE APPARATUS UTILIZING PLAYER IDENTIFICATION AND PLAYER TRACKING

CROSS-REFERENCE TO RELATED APPLICATION

This application is a continuation-in-part of U.S. patent application Ser. No. 18/097,345 filed Jan. 16, 2023, which is a continuation-in-part of U.S. patent application Ser. No. 17/408,147 filed Aug. 20, 2021, which is a continuation-in-part of U.S. patent application Ser. No. 17/093,321 filed Nov. 9, 2020, and which claims priority from U.S. Patent App. Ser. No. 62/933,497 filed Nov. 10, 2019, the entire disclosures of which are hereby incorporated by reference.

BACKGROUND

A ball machine that projects balls at a player may be used to develop player skills, provide a fitness workout, or provide recreational activity. The ball machine may be utilized in racket sports, such as tennis, pickleball, paddle tennis, padel, platform tennis, etc. Typically, these ball machines have speed control knobs that allow an operator to adjust various motors and actuators to "dial-in" a ball launch (i.e., shot) that the player wants to practice. This "dial-in" practice is time consuming and cumbersome.

In many instances, for example in group sessions in which multiple players are on a court, it is difficult to vary the type of projection of a ball and the accurate placement of the projected ball with respect to each of the individual players. To accomplish this, the ball machine would need to detect, track, and assign a unique identifier to each of the individual players. Conventional ball machines are unable to perform these functions.

SUMMARY

A ball machine comprising an imaging system attached to the ball machine and configured to capture image data of a playing surface of a court. The ball machine further comprising a processor configured to analyze a first frame of the image data using a neural network to detect a plurality of persons in the first frame, determine, using coordinate mapping, a coordinate position on the playing surface of each of the plurality of detected persons in the first frame, extract, from the first frame, features of each of the plurality of detected persons in the first frame, generate, using the extracted features of each of the plurality of detected persons in the first frame, a first set of feature vectors corresponding to the plurality of detected persons in the first frame, each of the first set of feature vectors being different from each other, associate a first feature vector, included in the first set of feature vectors, to the coordinate position on the playing surface of a first detected person included in the plurality of detected persons in the first frame to generate a first unique identifier, associate a second feature vector, included in the first set of feature vectors, to the coordinate position on the playing surface of a second detected person included in the plurality of detected persons in the first frame to generate a second unique identifier, and control settings of the ball machine to provide first settings based on the first unique identifier and to provide second settings based on second unique identifier, the second settings being different from the first settings. The ball machine further comprising a ball launching system configured to launch balls based on the first settings and the second settings.

A method of operating a ball machine, the method comprising capturing, using an imaging system attached to the ball machine, image data of a playing surface of a court; analyzing a first frame of the image data using a neural network to detect a plurality of persons in the first frame, determining, using coordinate mapping, a coordinate position on the playing surface of each of the plurality of detected persons in the first frame, extracting, from the first frame, features of each of the plurality of detected persons in the first frame, generating, using the extracted features of each of the plurality of detected persons in the first frame, a first set of feature vectors corresponding to the plurality of detected persons in the first frame, each of the first set of feature vectors being different from each other, associating a first feature vector, included in the first set of feature vectors, to the coordinate position on the playing surface of a first detected person included in the plurality of detected persons in the first frame to generate a first unique identifier, associating a second feature vector, included in the first set of feature vectors, to the coordinate position on the playing surface of a second detected person included in the plurality of detected persons in the first frame to generate a second unique identifier, and controlling settings of the ball machine to provide first settings based on the first unique identifier and to provide second settings based on second unique identifier, the second settings being different from the first settings; and launching balls based on the first settings and the second settings.

BRIEF DESCRIPTION OF THE DRAWINGS

The above and other objects, features, and advantages of the inventive concept will become more apparent to those skilled in the art upon consideration of the following detailed description with reference to the accompanying drawings.

DETAILED DESCRIPTION OF EXEMPLARY EMBODIMENTS

Figure 1:
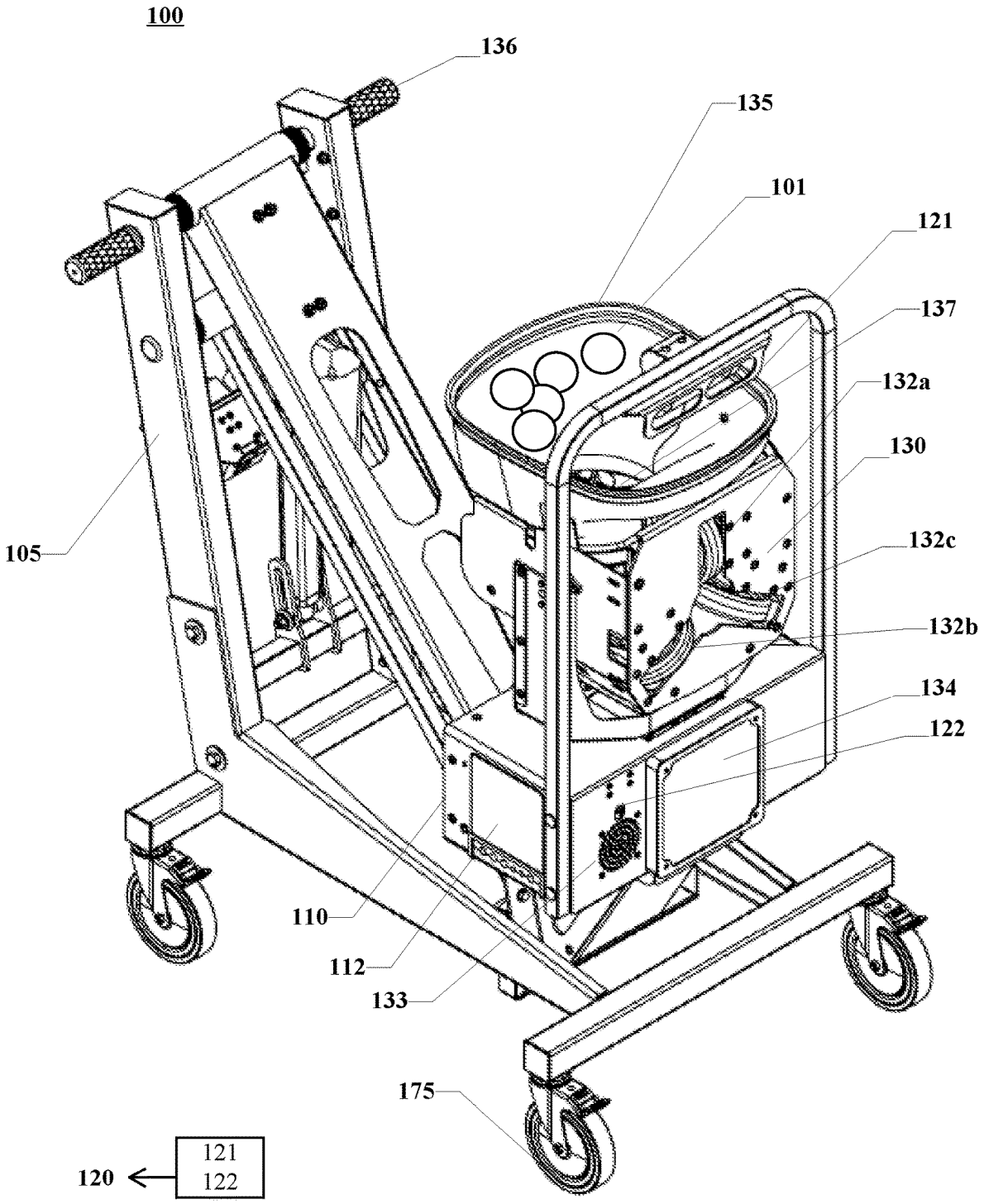
FIG. 1 illustrates an isometric front view of an automatic ball machine in a lowered position according to example embodiments.
Figure 2:
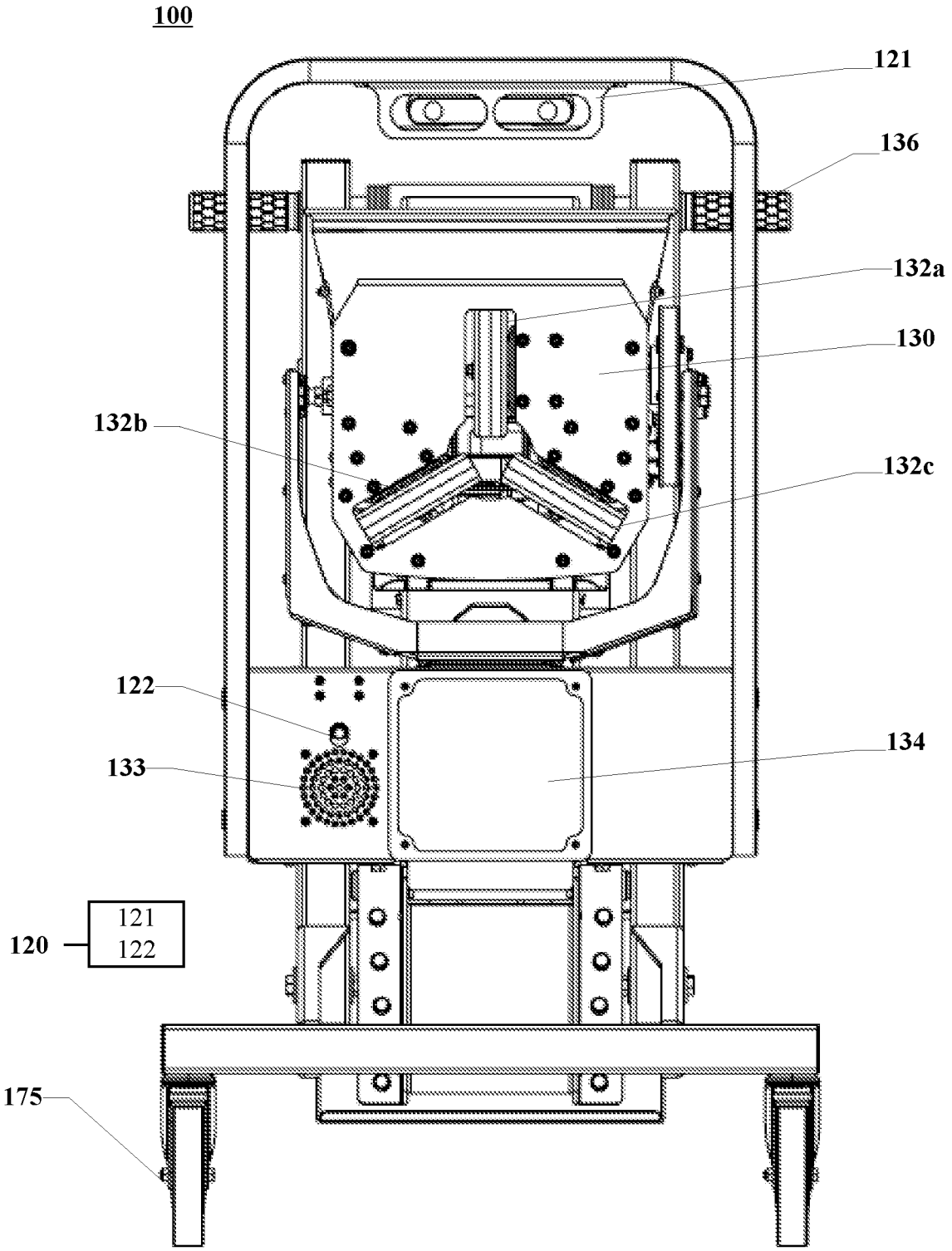
FIG. 2 illustrates a front view of the automatic ball machine in a lowered position according to example embodiments.
Figure 3:
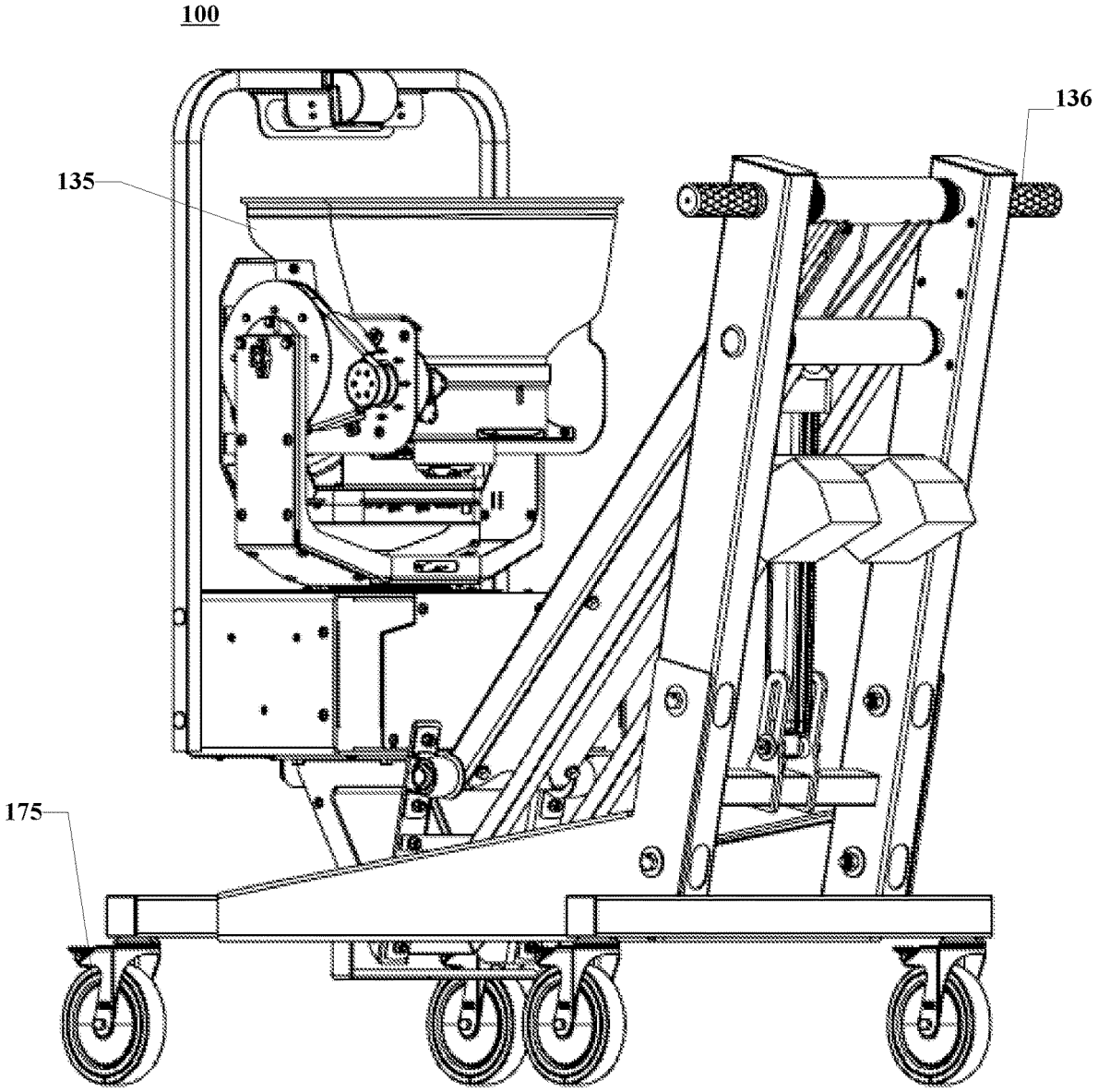
FIG. 3 illustrates an isometric rear view of the automatic ball machine in a lowered position according to example embodiments.
Figure 4:
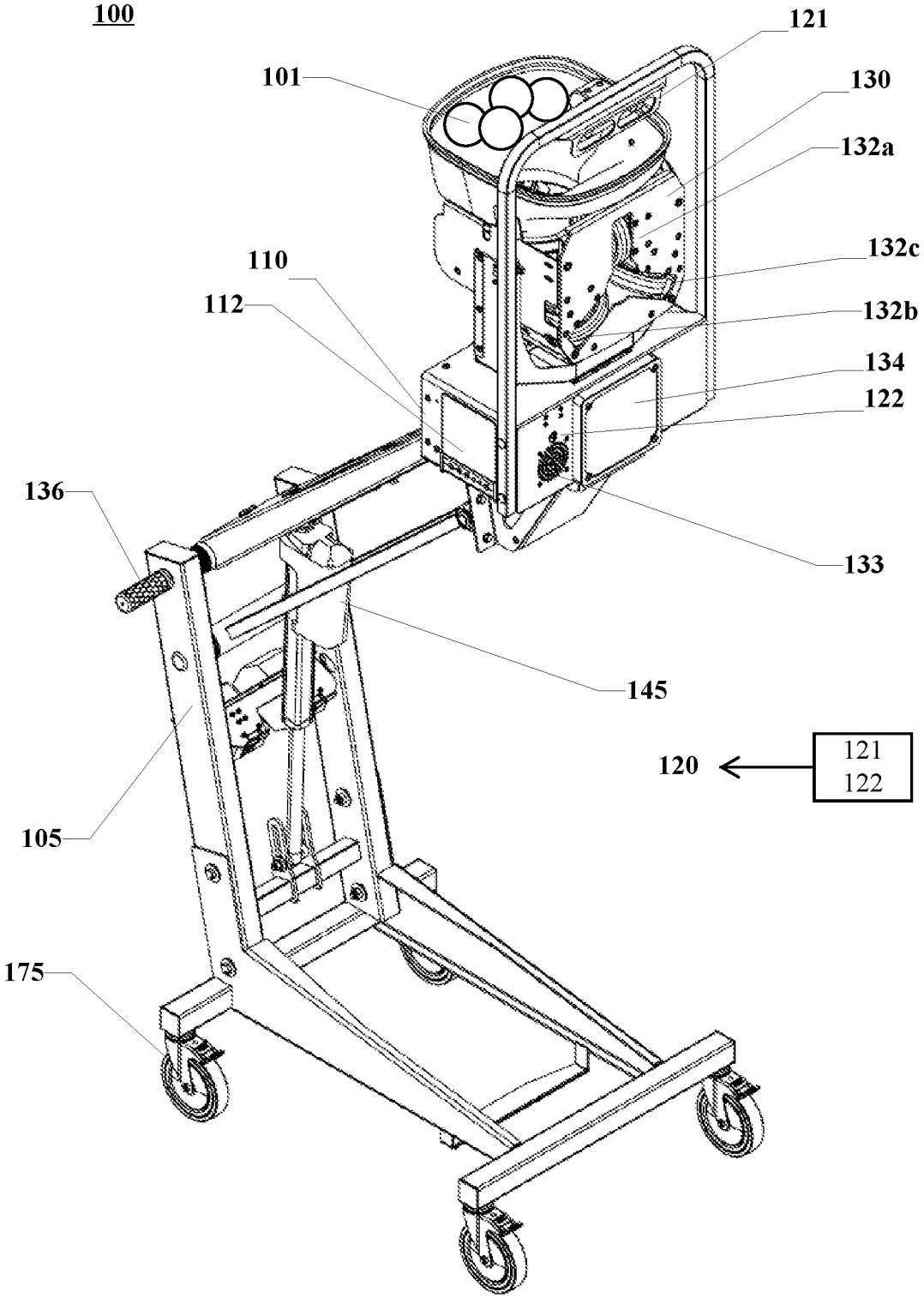
FIG. 4 illustrates an isometric front view of the automatic ball machine in a raised position according to example embodiments.
Figure 5:
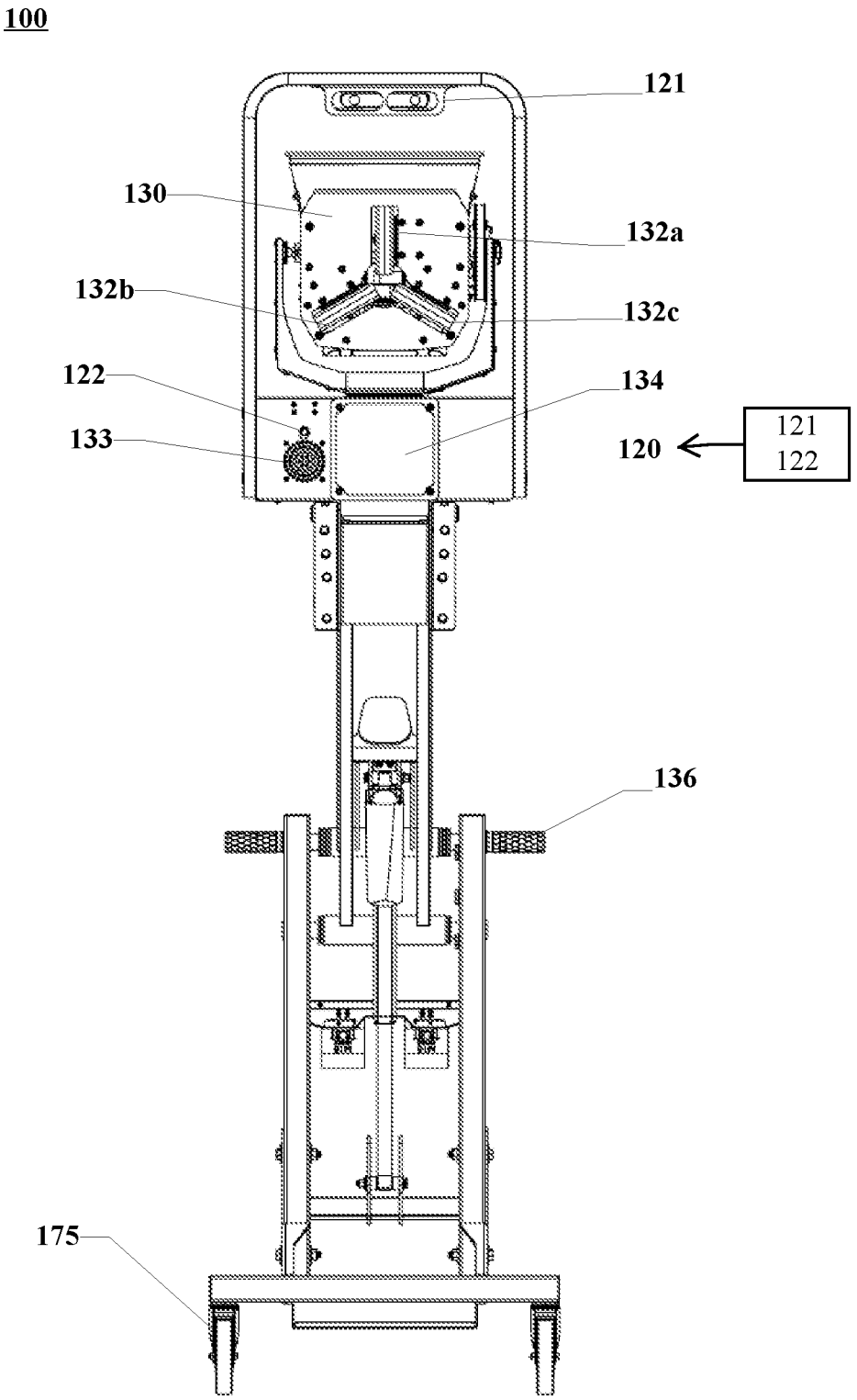
FIG. 5 illustrates a front view of the automatic ball machine in a raised position according to example embodiments.
Figure 6:
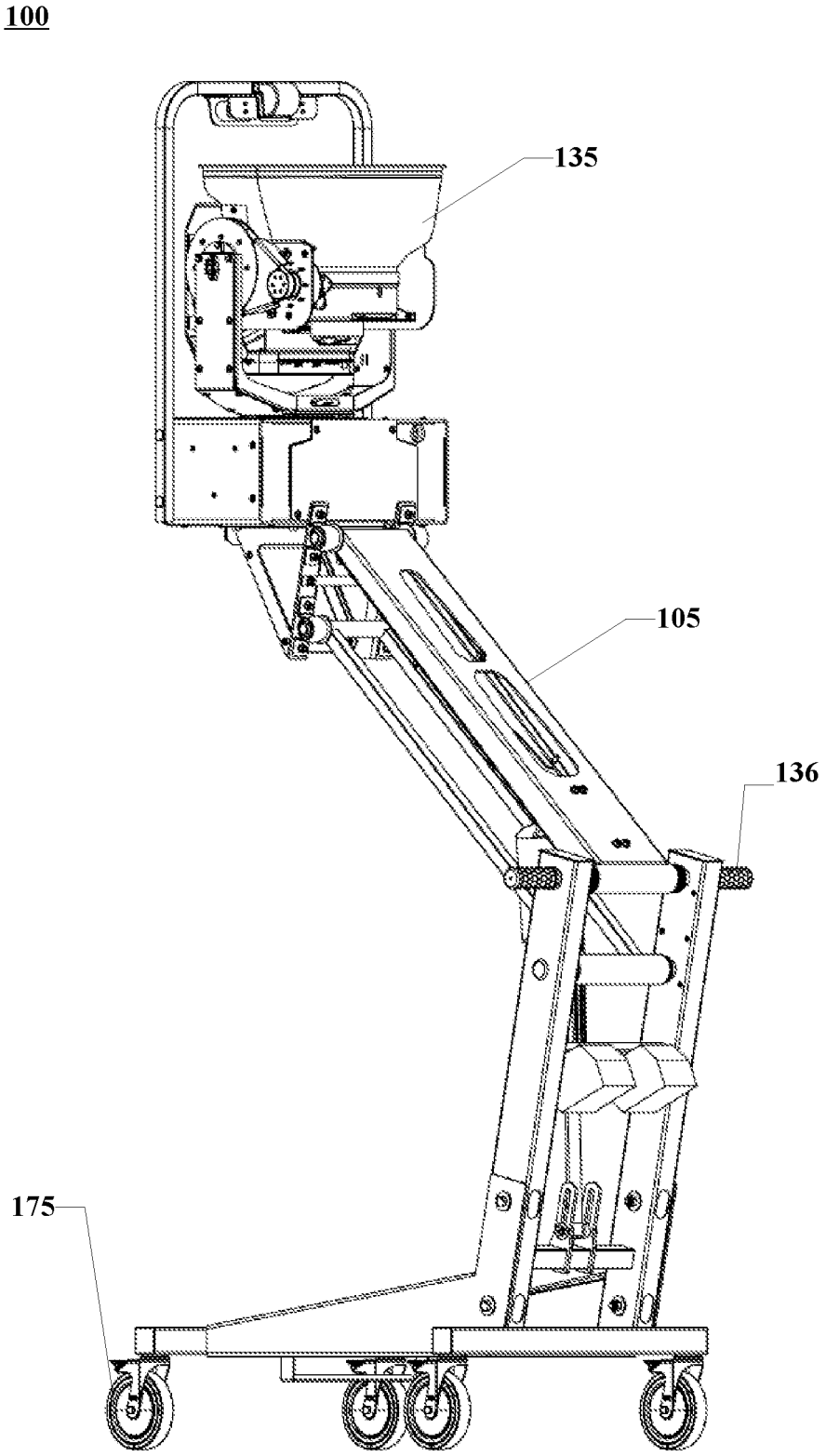
FIG. 6 illustrates an isometric rear view of the automatic ball machine in a raised position according to example embodiments.

Various aspects of the inventive concept will be described more fully hereinafter with reference to the accompanying drawings.

FIGS. 1-6 illustrate varying orientation views of an automatic ball machine 100 according to example embodiments. Referring to FIGS. 1-6, the automatic ball machine 100 may include a frame 105 onto which various components are coupled, such as a controller 110, a first camera 121, and a second camera 122 mounted inside controller 110. Although the entirety of the second camera 122 is not illustrated in the drawings, the optical input of the second camera 122 is illustrated in the drawings above speaker 133. The automatic ball machine 100 may include a ball launching system 130 to launch (i.e., project) balls 101, a hopper 135 to store a quantity of the balls 101 prior to launch, a mobility system 175 to move the automatic ball machine 100, and handles 136 configured to maneuver and adjust the automatic ball machine 100. Components of the automatic ball machine 100 may be physically connected to each other through the frame 105 of the automatic ball machine 100. For example, the first camera 121 and the second camera 122 (collectively referred to herein as "imaging system 120") are physically connected to the ball launching system 130 through the frame 105. The height position, in the vertical direction, of the automatic ball machine 100 is shown in a lowered position in FIGS. 1-3 and in a raised position in FIGS. 4-6. However, the height position of the automatic ball machine 100 may be adjusted and set anywhere in-between the illustrated lowered position and the illustrated raised position depending, for example, upon the trajectory needed to launch the balls 101 by the ball launching system 130. The height position of the automatic ball machine 100 may also range from the lowered position to the raised position during a localization operation for automatically determining the location of the automatic ball machine 100 on the court, detailed in application Ser. No. 18/097,345 ("the '345 application) filed on Jan. 16, 2023, the entire content of which is herein incorporated by reference. The automatic ball machine 100 may further include a ball feeder 137 to control, via the controller 110, feeding of balls 101 to the ball launching system 130, such as from the hopper 135.

According to example embodiments, the imaging system 120 may be disposed on the automatic ball machine 100 to capture digital images (e.g., video frames or frames) in a direction in which balls 101 are launched from the automatic ball machine 100. The first camera 121 and second camera 122 may be positioned to capture digital images at two different vantage points. Information may be extracted from the digital images through computer vision. In an example embodiment, the first camera 121 of the imaging system 120 may be a stereo camera. In another example embodiment, first camera 121 and second camera 122 of the imaging system 120 may be replaced with a Time-Of-Flight (TOF) camera to detect a depth of field.

In a further example embodiment, the imaging system 120 may include cameras in addition to cameras 121 and 122 to improve the data that is being received by the controller 110. For example, the imaging system 120 may include a plurality of cameras to detect objects to the left of the launch direction, to the right of the launch direction, and away from the launch direction, respectively. The plurality of cameras may increase an effective field-of-view of the imaging system 120.

The ball launching system 130 may include a plurality of spinner wheels, coupled to a plurality of motors, to launch the balls 101. For example, the ball launching system 130 may include first, second, and third spinner wheels 132*a*, 132*b*, 132*c*, coupled to first, second, and third spinner motors, respectively. As illustrated for example in FIG. 2, the spinner wheel 132*a* is shown as being disposed at approximately (+/−5 degrees) of the 12 o'clock position, with the spinner wheel 132*c* being disposed at approximately (+/−5 degrees) of the 4 o'clock position, and the spinner wheel 132*b*, being disposed at approximately (+/−5 degrees) of the 8 o'clock position.

In addition to performing functions related to person detection, person identification, person tracking, and pose estimation procedures described in further detail below, the first camera 121 may also act as an environment sensor to detect objects in a direction that balls 101 are being launched from the automatic ball machine 100. For example, the automatic ball machine 100 may use the first camera 121 as an environment sensor to monitor, via the controller 110, an area in a direction that the ball 101 is being launched, and in at least one configuration around the automatic ball machine 100 to ensure no person or unintended objects are struck by the balls 101 being launched by the automatic ball machine 100, or harmed by any automated mechanical movement of the automatic ball machine 100. The automatic ball machine 100 may establish a keep-out region, that if violated, will result in the automatic ball machine 100 stopping launching of the balls 101 and/or mechanical movement, such as the ball launching system 130, and in at least one configuration issuing a warning to a player. The warning may comprise a visual cue via, for example, a display device 134 or a lighting system (not illustrated). The warning may also comprise an audio cue via, for example, a speaker 133. The display device 134 may be a flat-panel display, such as an LCD display, an LED display, an OLED display, a QLED display, or the like.

The automatic ball machine 100 may adjust a distance the keep-out region extends from the automatic ball machine 100 based on a court location of the automatic ball machine 100. To vary the coverage area around the automatic ball machine 100, additional environment sensors may be included. For example, the automatic ball machine 100 may include an additional environment sensor, such as a Light Detection and Ranging (LiDAR) sensor or similar, to detect objects outside a field-of-view of the imaging system 120, and/or to provide backup or additional data for the controller 110. A full 360-degree coverage around the automatic ball machine 100 may be implemented via additional environment sensors, for example, LiDAR sensors. In other configurations, additional environment sensors may further include, for example, barometric sensors, temperature sensors, humidity sensors, anemometer sensors, and the like.

Figure 7:
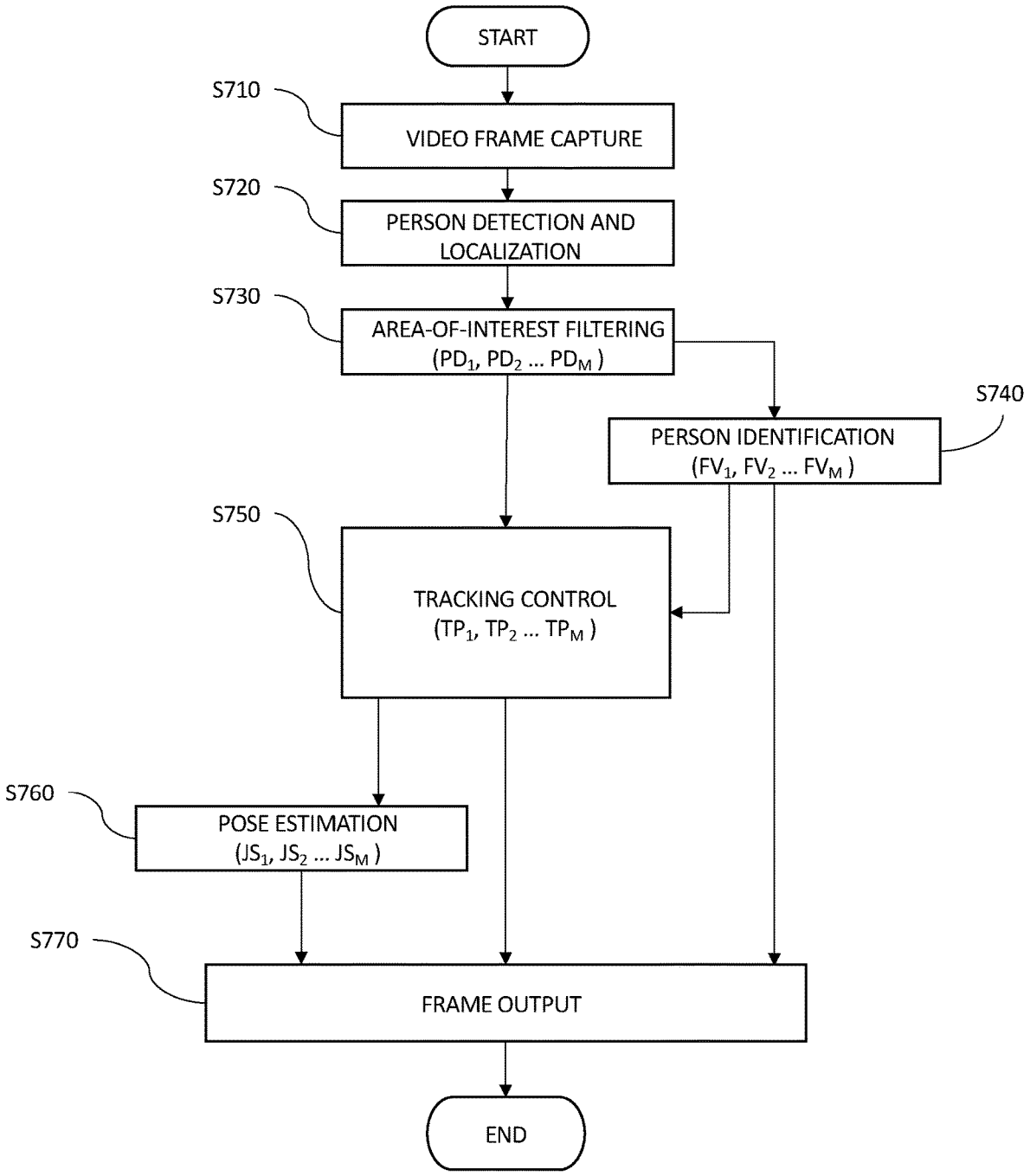
FIG. 7 illustrates a flowchart of a person detection, person identification, person tracking, and pose estimation procedures according to example embodiments.

FIG. 7 illustrates a flowchart setting forth exemplary steps of a person detection, person identification, person tracking, and pose estimation procedures with respect to a person on a court (i.e., a player, human). Aspects of the person detection, person identification, and the pose estimation procedures may be executed by one or more artificial neural networks. The terms "artificial neural network" and "neural network" are used synonymously herein.

As used herein, the term "court" refers to: a flat playing surface including a flat rectangular playing area defined by line markings on the flat playing surface; structures that are a part of the playing area; and enclosures surrounding the playing surface. The line markings may delineate regions within the playing area (e.g., a service box) and boundaries of the playing area (e.g., a side line and a base line) on the playing surface. The playing surface may extend beyond the boundaries of the playing area. Structures that are a part of the playing area may include a net, a cord or cable suspending the net, and net posts to which the net, suspended by the cord or cable, is attached. In racket sports such as platform tennis and padel, wherein the official rules and regulation of the games, provides for a ball to be played off (i.e., come into contact with) an enclosure surrounding the playing surface during regulation game play, the enclosures may be a part of the "court" as used herein. With respect to platform tennis, the enclosure may be comprised of a screen. With respect to padel, the enclosure may be comprised of walls formed of a transparent or opaque material and walls comprised of metal fencing.

Referring to FIG. 7, an initial step may include receiving a video frame from a video being captured of the court by, for example, imaging system 120 (S710). Each video frame may be subject to computer vision procedures executed by a plurality of neural networks. For example, in step S720, a person detection computer vision procedure is performed with respect to the received video frame (e.g., "a first video frame," "first frame," or "a first image"). The person detection procedure may be executed by a neural network trained to detect a class of objects in the first video frame (i.e., "object detection"), in this instance the class of objects is a person, and draw a bounding box around each of the detected persons in the received video frame (i.e., "object localization"). The object (i.e., person) detection may be based on a binary determination (e.g., person detected=yes and person detected=no) or the object detection may be based on a probabilistic determination. In a probabilistic determination, the neural network may generate, for each outputted bounding box, a probability of the enclosed object being a person.

Subsequently, a localization procedure may be conducted to determine a real world position of the detected person in the image. The real world position of the detected person is determined with respect to the playing surface of the court. For example, as detailed in the '345 application, a trainer localization operation may be executed by the automatic ball machine 100 to automatically determine the location of the automatic ball machine 100 on the playing surface of a court in part by mapping (i.e., coordinate mapping) the three dimensional (3D) world coordinate system (i.e., "3D world space" or "world space") of a court model into the image space (i.e., a two dimensional (2D) space that uses pixel coordinates). For example, by projecting a ray from the center of the camera to a center position at the bottom of the bounding box, which is substantially equivalent to the feet of the detected person in the bounding box, a 2D coordinate position of the intersection of the ray with the bounding box in image space may be obtained. Utilizing the mapping disclosed in the '345 application, the obtained 2D coordinate position is translated to the 3D world coordinate system to determine the position of the detected person on the playing surface of the court. As another example, a pose estimation process may be used to obtain a 2D coordinate position of a foot of a detected person in image space. When occlusions occur, such as behind the net, and pose position for the foot cannot be obtained, an upper body pose of the detected person may be used to estimate the 2D coordinate position of a foot of the detected person in image space. Utilizing the mapping disclosed in the '345 application, the obtained 2D coordinate position is translated to the 3D world coordinate system to determine the position of the detected person on the playing surface of the court.

As multiple persons may be positioned on the court, the person detection procedure may detect a plurality of persons in each image and draw a bounding box around each of the detected persons. The localization procedure may therefore output a position of each of the detected persons on the playing surface of the court. An area of interest filtering procedure (S730) may be conducted to filter out, from the detected persons, only persons that are positioned in a determined area of interest with respect to the playing surface of the court (S730). For example, the determined area of interest may be the playing surface, the playing area, or a section of the playing area (e.g., within a service box). The area of interest filtering may be conducted on one or more of the determined areas of interest. In an exemplary embodiment, the area of interest filtering procedure (S730) may additionally be used to classify a person based on a position of the person in a determined area of interest with respect to the playing surface of the court. For example, the area of interest filtering procedure (S730) may classify a person as a player, coach, spectator, etc., based on the position of the person in a determine area of interest with respect to the playing surface of the court.

Subsequent to the area of interest filtering (S730), detected persons in the determined area of interest may be outputted to a person identification neural network (S740) and a tracking control system (S750). For illustrative purposes, each detected person in the determined area of interest and size and position of each detected person may be representative as, for example, a detected person identifier (i.e., $PD_1$, $PD_2$ . . . $PD_M$). For example, the detected person identifier may include data indicating the width and height of the detected person, the x-offset and the y-offset of the detected person with respect to the video frame (i.e., the 2D coordinate position), and the real world position of the detected person on the playing surface (i.e., the 3D world coordinate position). The detected persons identifier (i.e., $PD_1$, $PD_2$ . . . $PD_M$) may be outputted to the person identification neural network (S740) and the tracking control system (S750).

In step S740, the person identification neural network may analyze features of each individually detected person in the determined area of interest to generate a feature vector (e.g., $FV_1$, $FV_2$, . . . $FV_M$) for each detected person in a frame. A "re-identification" or a "RE-ID" process may be used to generate the feature vector. The "re-identification" or "RE-ID" process is a process in which the person identification neural network is capable of determining if a detected person is the same person across different video frames captured by the imaging system 120. For example, the person identification neural network may generate, per frame, a feature vector (i.e., a person-specific feature vector that includes a set of feature values corresponding to extracted features) for each detected person in the determined area of interest. "Features" refer to the image characteristics that are extracted by a neural network, that are based on the training and subsequent learning of the neural network, and that represent distinguishing characteristics of the person (i.e., detected person). Nonlimiting examples of features may encompass the physical appearance/attributes of a detected person, such as the skin color of a detected person, the size of a detected person, the accessories (e.g., hat, glasses, etc.) worn by a detected person, the type, style, color, pattern of clothes worn by a detected person, color distribution, gradient changes, etc. The person-specific feature vector size N may be on the order of 100's of features (e.g. N=128 or 256). Subsequent to generating a feature vector (e.g., $FV_1$, $FV_2$ . . . $FV_M$) for each detected person in a frame, the generating feature vectors are outputted to the tracking control system (S750) and the frame output (S770).

The multiple different feature vectors, each containing N feature values, may be plotted as points in an N-dimensional space. For example, each feature may be represented as a number (i.e., feature value); thus each feature vector may be represented/plotted as a point in N-dimensional space, and the feature vector corresponding to a detected person over time (multiple frames) may be represented/plotted as a cluster of points in N-dimensional space. As each frame may include multiple detected persons, according to aspects of the invention, the person identification neural network is trained to extract features and generate feature values that maximize the Euclidian or other mathematical distance (when represented/plotted in N-dimensional space) of the feature vectors between different detected persons and minimizes the distance of feature vectors corresponding to the same detected person. Accordingly, the feature vectors when represented/plotted over time (i.e., over multiple frames) as points in the N-dimensional space will produce multiple clusters of points that are mathematically distant from each other and correspond to different detected persons. A comparison of the mathematical distance between clusters of points or individual points may be referred to as a similarity measurement.

Based on an initial frame (e.g., a first fame or frame 1), the tracking control system may associate each of the detected person identifiers (i.e., $PD_1$, $PD_2$ . . . $PD_M$) with a feature vector (e.g., $FV_1$, $FV_2$ . . . $FV_M$) (S750). For example, the tracking control system may associate, when the mathematical distance among points (e.g., a first point corresponding to $FV_1$, a second point corresponding to $FV_2$, etc.) is greater than a predetermined threshold, each of the points with a detected person identifier (i.e., $PD_1$, $PD_2$ . . . $PD_M$). As an example, the tracking control system may associate the first point with a first detected person (e.g., $PD_1$), the second point with a second detected person e.g., $PD_2$), etc.

Over multiple frames, the feature vectors when represented/plotted over time as points in the N-dimensional space will produce multiple clusters of points, wherein the tracking control system may associate each of the detected persons identifier with one of the multiple cluster of points. For example, over the multiple frames, the tracking control system may associate, when the mathematical distance among a cluster of points (e.g., a first cluster of points corresponding to $FV_1$, a second cluster of points corresponding to $FV_2$, etc.) is greater than a predetermined threshold, each of the cluster of points with a detected person identifier (i.e., $PD_1$, $PD_2$ . . . $PD_M$). As an exemplary example, over the multiple frames, the tracking control system may associate a first cluster of points with a first detected person (e.g., $PD_1$), a second cluster of points with a second detected person e.g., $PD_2$), etc.

The feature vector (e.g., extracted features, feature values, etc.) of a detected person in a frame may change from frame to frame. For example, if the orientation of a first detected person (e.g., $PD_1$) in a first frame (e.g., frame 1) is a front facing orientation with respect to the imaging system 120 and the orientation of the first detected person (e.g., $PD_1$) in a second frame (e.g., frame 2) is profile facing orientation with respect to the imaging system 120, the host of features extracted by the person identification neural network in frame 1 for the first detected person $PD_1$ will be different from the host of features extracted by the person identification neural network in frame 2 for the first detected person $PD_1$. As a result of the different orientations of the first detected person PD1 from frame 1 to frame 2, the feature values related to the size of the first detected person $PD_1$ may be different from frame 1 to frame 2. As an additional example, as a result of the different orientation of the first detected person from frame 1 to frame 2, the feature values related to the color or pattern of the clothing worn by the first detected person $PD_1$ may be different from frame 1 to frame 2. As a result of these differences in extracted features and feature values corresponding to the first detected person $PD_1$ from frame 1 to frame 2, the person identification neural network may generate a different feature vector (i.e., a different point when represented/plotted as a point in N-dimensional space) for the first detected person $PD_1$ in frame 2 than the feature vector generated for the first detected person $PD_1$ in frame 1.

The feature vector of a detected person may not only change based on the orientation or position of the person, but may also change based on the addition or removal of clothing and accessories worn by the detected person. For example, if the first detected person $PD_1$ were to put on a hat in frame 3, the feature vector generated for the first detected person $PD_1$ in frame 3 would be different from the feature vectors generated for the first detected person $PD_1$ in frames 1 and 2. Accordingly, multiple different feature vectors (i.e., a different points) may correspond to the same detected person (e.g., $PD_1$) across multiple frames. However, over multiple frames, points corresponding to the same detected person will tend to cluster close to each other, because of the overall similarity in appearance of a person over the multiple frames despite these changes, to form a cluster of points.

The tracking control system may correctly associate the same detected person (e.g., $PD_1$) to the multiple different feature vectors corresponding to the same person (e.g., $PD_1$) across multiple frames (S750). For example, the tracking control system may associate (i.e., match) a feature vector (i.e., a point in N-dimensional space) generated by the person identification neural network in a current frame with the "closest" or "similar" feature vector (i.e., a point in N-dimensional space) from a previous frame or with the "closest" or "similar" feature vectors (i.e., a cluster of points in N-dimensional space) from previous multiple of frames. As used herein, and in this context, the terms "closest" and "similar" may be defined with respect to Euclidean or other mathematical distance measurement in feature vector space such that a mathematical distance measurement less than a predetermined threshold may satisfy the requirement of "closest" and similar". In addition, if a generated feature vector of a detected person in the current frame is "too far" or "dissimilar" (i.e., greater than a predetermined distance threshold) from feature vectors from previous frames that have been previously associated with detected persons, the tracking control system may conclude that this feature vector in the current frame belongs to a new (heretofore undetected) person and, therefore, associates the new feature vector to a newly detected person. As used herein, and in this context, the terms "too far" and "dissimilar" may be defined with respect to Euclidean or other mathematical distance measurement in feature-vector space such that a mathematical distance measurement greater than or equal to a predetermined threshold may satisfy the requirement of "too far" and "dissimilar."

In a given video frame analyzed by the person detection neural network in step S720, the person detection neural network may fail to detect a person that is actually present in the given video frame (i.e., "person detection miss"). This failure may be caused, for example, by the person enacting a pose that fails to conform to the trained data requirements of the person detection neural network. This failure may also be caused by the person being occluded from view of the imaging system 120 by, for example, another person, an object, sun or lighting glare, etc. These failures to detect a specific person by the person detection neural network may occur in only a subset of the frames analyzed by the person detection neural network.

The tracking control system may correct for the person detection miss of the person detection neural network by maintaining a history of the position of the person and predicting a future position of the person in a subsequent frame. For example, the tracking control system is configured to predict, based on a tracked path of a detected person, calculated utilizing a plurality of positions (i.e., 2D coordinate positions and 3D world coordinate positions of the detected person), their position in a subsequent frame. For each person, the tracking control system remembers the tracked path (where the person has been for a time window), and predicts the position of the person in the next frame. The tracking control system may use, for example, the Intersection over Union methodology and Kalman filter to perform positional tracking over time and may extrapolate to predict/estimate the position of such an undetected person (i.e., "missed person"). In this way, in the event of a person detection miss, the system can "fill in" person-detection gaps and achieve overall greater tracking accuracy. For example, when a person that has been detected in a previous frame is not detected in a current frame, the tracking control system will still conclude that the person is in fact present in the current frame and located at a predicted position in the current frame based on the tracked path of the person. The tracking control system may continue to maintain the presence of such an undetected person (i.e., "missed person") over a predetermined number of subsequent frames. After the predetermined number of subsequent frames has elapsed, the tracking control system will no longer maintain the presence of such an undetected person and will then conclude that the undetected person has in fact left the area of interest (i.e., not a "missed person").

Additionally, in a particular video frame, the person detection neural network may also err in identifying as a detected person, an object that is not actually a person (i.e., "false person detection"). The object falsely identified as a person may be given, for that particular frame, a detected person identifier (e.g., $PD_1$, $PD_2$ . . . $PD_M$) that is outputted to the tracking control system in step S750.

The tracking control system may correct for the false person detection errors of the person detection neural network by utilizing the feature vector corresponding to each detected person generated by the person identification neural network in step S740 in addition to the predicted position of a person as discussed above. For example, in the event of a false person detection, the tracking control system may determine that such a detected person is in fact not a person based on a comparison to one or both of predicted positions and previously generated feature vectors.

Additionally, by associating the detected persons with specific feature vectors, the tracking control system is enabled to "remember" individuals that leave the area of interest and then return. For example, if after being tracked in-scene for a period of time a person leaves the area of interest (not detected in a plurality of continuous frames) and then returns (i.e., detected in a subsequent frame), that person may be correctly "re-identified" as a known individual instead of wrongly identified as a heretofore unknown person. For example, when the person returns and is detected in a frame (e.g., the subsequent frame), the person identification neural network in step S740 may generate a feature vector for the returned person. When the newly generated feature vector for the returned person is received by the tracking control system, the tracking control system may compare and associate the newly generated feature vector of the returned person to an existing detected person when the mathematical distance of feature vectors previously associated with the detected person (i.e., the cluster of points associated with the detected person) and the newly generated feature vector is less than a predetermined threshold.

The tracking control system outputs tracked persons (i.e., $TP_1$, $TP_2$ . . . $TP_M$) to a pose estimation neural network (S760) and frame output (S770). The outputted tracked persons identifiers (i.e., $TP_1$, $TP_2$ . . . $TP_M$) may include positional data corresponding to a detected person and respective feature vectors that have been determined to be similar to each other by the tracking control system. Accordingly, each of the tracked persons identifiers (i.e., $TP_1$, $TP_2$ . . . $TP_M$) may represent a unique identifier of detected persons (i.e., a player). As discussed above, the positional data included in the unique identifier may comprise data indicating the width and height of the detected person, the x-offset and the y-offset of the detected person with respect to the video frame (i.e., the 2D coordinate position), and the real world position of the detected person on the playing surface (i.e., the 3D world coordinate position).

In step S760, the pose estimation neural network extracts joint information for each of the detected persons corresponding to the tracked persons identifiers (unique identifiers) (i.e., $TP_1$, $TP_2$ . . . $TP_M$) received from the tracking control system. The extracted joint information for each of the detected persons corresponding to the tracked persons identifiers (unique identifiers) (i.e., $TP_1$, $TP_2$ . . . $TP_M$) may be used to generate a pose estimation (i.e., $JS_1$, $JS_2$ . . . $JS_M$) for each of the tracked persons. The pose estimation may be modeled as a kinematic model, a planar model, or a volumetric model, for example.

In step S770, for each frame, data including the tracked persons, the feature vector corresponding to each of the tracked persons, and the pose estimation for each of the tracked persons may be outputted.

Although the above description of the player detection, player identification, player tracking, and pose estimation procedures includes computer system resources provided on the automatic ball machine 100, aspects of the invention are not limited to such a description. For example, computer system resources utilized by the player identification, player tracking, and pose estimation procedures may be provided through distributed computing, such as cloud computing. For example, storage of the video frames and computing power to execute the processing steps of the player identification, player tracking, and pose estimation procedures may be provided through distributed computing, such as cloud computing.

As a result of determining the tracked persons, the feature vectors corresponding to each of the tracked persons, and the pose estimation for each of the tracked persons using the procedures as described with respect to FIG. 7, the controller 110 has the ability to individually adjust one or more settings of the automatic ball machine 100 in accordance with one or more of the 3D world coordinate position and pose of a uniquely identified person among a plurality of uniquely identified persons. For example, the controller 110 may individually adjust one or more settings of the ball launching system 130 and/or the height actuator 145. In an exemplary embodiment, the controller 110 may individually adjust one or more of a speed, tilt, roll, and yaw of the spinner wheels 132*a*, 132*b*, 132*c* and position of the height actuator 145 to place the balls 101 in an acceptable location for a specific player from among a plurality of players located on the playing surface.

Figure 8:
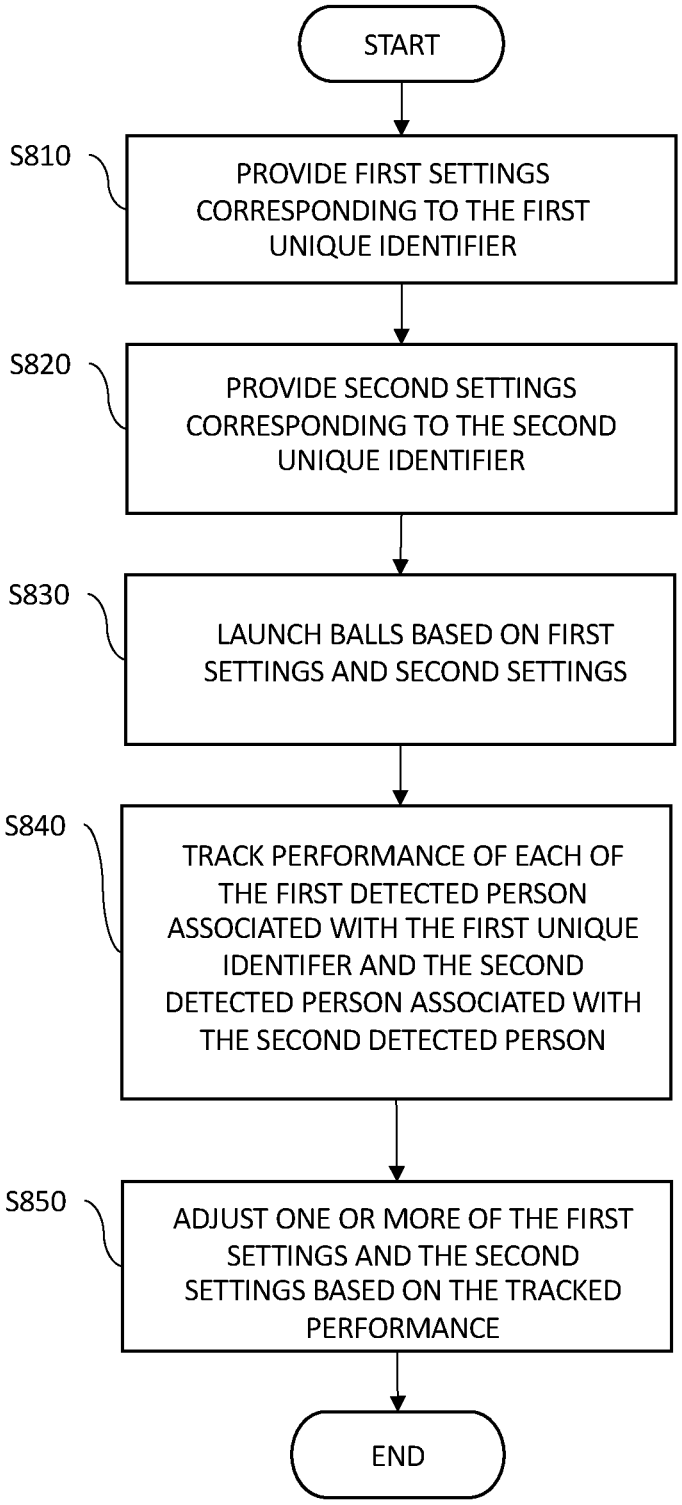
FIG. 8 illustrates a flowchart of controlling the automatic ball machine.

FIG. 8 illustrates a flowchart setting forth exemplary steps of controlling the automatic ball machine 100 utilizing the data output for each frame as set forth in step S770 of FIG. 7. For example, in step S810, the controller 110 may adjust the settings of the automatic ball machine 100 to provide first settings that correspond to a first detected person. In step S820, the controller may adjust the settings of the automatic ball machine 100 to provide second settings, different from the first settings, that correspond to a second detected person. In step S830, the controller may control the automatic ball machine 100 to launch balls based on the respective first settings and the second settings.

In step S840, the controller may track the performance of each of the first detected person and the second detected person over a finite period of time. For example, the performance of each of the first detected person and the second detected person may be based on, for example, one or more of the 3D world coordinate position and pose of the detected person when a ball is launched at the detected person and the 3D world coordinate position and pose of the detected person when a ball is played (e.g., hit, returned, etc.) by the detected person. The performance of a detected person may also be based on, for example, a tracked return flight of the ball 101 played by the detected person. The finite period of time may correspond to the duration of, for example, an instructional class or a training session. As the performance of a detected person improves over the finite period of time, the controller may adjust settings of the machine 100 to increase the difficulty of balls launched (e.g., increased speed, increased spin, etc.) to the detected person. Conversely, as the performance of a detected person worsens over the finite period of time, the controller may adjust settings of the machine 100 to decrease the difficulty of balls launched (e.g., decreased speed, decreased spin, etc.) to the detected person. As the performance of each of the detected persons may vary independently over the finite period of time, the controller may independently adjust settings of the automatic ball machine 100 corresponding to each of the detected persons over the finite period of time. Although only a first detected person and a second detected person are discussed with respect to the method of controlling the automatic ball machine 100 utilizing the data output for each frame as set forth in step S770 of FIG. 7, the method is not limited to only a first detected person and a second detected person. For example, the method may be utilized with respect to three or more detected persons.

In addition, a player (i.e., user) may use a control panel 112 (e.g., touchscreen) and/or a remote wireless device via a network 1900 (FIG. 9), such as a smartphone, to indicate where the player wants a ball 101 placed with respect to the determined 3D world coordinate position of the player. The controller 110 may execute the appropriate calculations, by solving a ball flight equation, to determine a speed and flight path needed to launch the ball 101 to place the ball 101 at the acceptable location for the recipient player.

As a result of determining the tracked persons and the feature vectors corresponding to each of the tracked persons, the automatic ball machine 100 may dynamically place the ball 101 relative to a first player, from among two or more players on the playing surface, to practice different shots, regardless of where the first player was initially positioned on the playing surface. Typical ball machines just repeat the same shot. If the player desires to practice a wide backhand 4' away, the player practicing may "cheat" and when they reset, they drift closer to where the ball flight will be. The automatic ball machine 100 may consistently place the ball 101 4' wide of the first player, regardless of where the first player is standing. Thus, the player drifting in their setup will have a benefit of being launched the ball 101 that is 4' away regardless of where they drift to, leading to a better, more consistent, practice experience.

The controller 110 may further use the imaging system 120 to track return flight of the ball 101 from a first player, from among two or more players on the playing surface, and provide ball 101 flight analytics on a practice session. Typical practice sessions involving multiple (i.e., a group of) players in the same practice session and using a typical ball machine do not yield performance data on performance of each player in the group of players. Accordingly, a player in a group training session cannot measure their performance from hitting balls launched by the typical ball machine in such a group training session. Using the above scenario, a first player in the group training session practicing a backhand 4' away, may receive a report from the automatic ball machine 100 after the group training session that details the specific performance of the first player. For example, the automatic ball machine 100 may detail how and how many balls 101 are returned, average speed of the returned balls 101, where did the return balls 101 go, and any another other analytic information for the first player in the group training session. Additionally, similarly specific performance reports corresponding to each of the individual players in the group training session may be outputted by the automatic ball machine 100.

Subsequent, for example, to a group instructional class or group training session, individual players who participated in group instructional class or group training session may use a user interface of the automatic ball machine 100 to associate tracked persons identifiers (i.e., $TP_1$, $TP_2$ . . . $TP_M$) to a player selected identifier corresponding to an individual player that participated in the group instructional class or group training session. For example, an exemplary player named "John Smith" may watch a video clip of the group instructional class or group training session captured by the automatic ball machine 100 that includes data indicating the tracked persons identifier associated with each player in the video clip. When the exemplary player visually recognizes themselves in the video clip, the exemplary player may replace or append the tracked persons identifier with a player selected identifier (e.g., the player's name John Smith). Accordingly, by replacing or appending the tracked persons identifier with a player selected identifier after a number of group instructional classes or group training sessions, performance data of a player may be tracked and maintained by the automatic ball machine 100 across multiple group instructional classes or group training sessions.

The controller 110 may further use the imaging system 120 to learn aspects of the games they are helping to train. This may include a starting position of the player(s), scenarios for common responsive shots, etc. For example, if a soft serve is low, the automatic ball machine 100 would know the possible returns and provide one accordingly, with only a certain set of shots that are possible. In another example, if the player serves and rushes the net, the automatic ball machine 100 may lob the ball 101 over the player's head instead of driving it past them.

The controller 110 may further use the imaging system 120 and/or other sensor systems (e.g., infrared sensors on the ball launching system 130) to dynamically adjust a speed of the spinner wheels 132*a*, 132*b*, 132*c*, such adjustments may be based on characteristics (e.g., speed, trajectory, etc.) of previous launched ball(s) 101. A common problem with conventional ball machines is that the spinner wheels attached to the motors as part of a ball launch system will wear over time and, as a result, flight of the balls will change over time. For example, with a new ball machine, a spinner motor coupled to a spinner wheel running at half speed may launch the ball 60 ft. However, with worn spinner wheels and the spinner motor running at half speed, the ball might only be launched 56 ft because of a change of trajectory. Such changes in trajectory may also be caused by wear in frame components, wear in bearings of the spinner wheels and/or spinner motors, and/or wear in any other components of the ball machine.

According to aspects of the present invention, the controller 110 may further use the imaging system 120 to determine the location of the ball 101 after being launched and determine if the ball 101 does not end up at the desired location, to further determine a location error. The controller 110 may dynamically adjust or calibrate one or more of a launch orientation (e.g., tilt, roll, and yaw) and a speed of the spinner wheels 132*a*, 132*b*, 132*c* to compensate for this location error such that a subsequent ball(s) 101 will be launched to the desired location. This process may be performed continuously, such that the controller 110 is continuously determining if location error exists for a ball launch, and continuously compensating for this location error.

The controller 110 may further use the imaging system 120 for safety. The controller 110 may use a field of vision of the imaging system 120 to detect if the ball's 101 flight is obstructed by an object, such as a person walking in front of the automatic ball machine 100. The controller 110 may withhold launching of the ball 101 as a safety measure to avoid hitting the object. Thus, by utilizing a field of vision depth estimation capabilities of the imaging system 120, if the controller 110 detects anyone (or anything) that is unexpected, the controller 110 may withhold/avoid throwing the ball 101 as a safety measure. For example, the automatic ball machine 100 may dynamically stop the first, second, third spinner wheels 132*a*, 132*b*, 132*c* to prevent the ball from being launched.

As an additional safety measure, the controller 110 may further adjust settings of the automatic ball machine 100 based on the detected size, included in the detected persons identification (i.e., $PD_1$, $PD_2$ . . . $PD_M$) data, of a detected person. For example, when the detected size of a detected person is less than a predetermined threshold, the controller 110 may determine that the detected person is a child. Accordingly, when the controller 110 determines that the detected person is a child, the controller may adjust settings of the automatic ball machine 100 that are associated with the detected person to decrease the speed at which balls are launched from the ball launching system 130.

The controller 110 may further use the imaging system 120 to adapt launching based on a particular player. For example, the automatic ball machine 100 may launch a responsive shot that would be representative of an opponent, for the person using it. Typically, all actions start with ball machines launching a ball. If a player wants to practice hitting a follow-up shot to a tennis serve, it is impossible with typical ball machines.

According to aspects of the present invention, the automatic ball machine 100 may be placed where a typical service returner would stand. When the player serves the ball, the controller 110, via the imaging system 120, may identify a ball 101 flight and speed of the serve and make a representative return shot. In at least one configuration, the automatic ball machine 100 may adjust a height of the ball launching system 130 using the height actuator 145 to thereby change the release point for the ball 101 and the ball's 101 trajectory. The representative return shot includes timing the return ball 101 so it coincides, time wise, with a return, the controller 110 adjusting, via the height actuator 145, a height of the ball launching system 130 so an ejection point is at an appropriate height of where a returner would hit it, and adjusting a speed at which the ball launching system 130 launches a return shot that would be representative of one that a returner could hit. For example, a slow, low serve typically cannot be driven back at the player, as a result of the return pace being limited by the slow speed and low trajectory of the incoming serve. However, a hard hit serve, with a high bounce, may be returned at a much faster rate. The automatic ball machine 100 may make adjustments based on these types of serve coming at it.

The controller 110 may further use the imaging system 120 to detect a visual indication in a field of vision of the imaging system 120 to trigger the ball 101 being launched. The controller 110 may detect and understand basic player positioning and determine when the player is ready to receive the ball 101. The controller 110 may then trigger the ball launching system 130 to launch the ball. Typical ball machines send balls either by a coach directly feeding them into the ball machine or based on a timer (e.g., one ball every 10 seconds). For example, the automatic ball machine 100 may wait until a player's posture is detected, based on the output of the pose estimation neural network, as being in a service return position. Alternatively, the visual indicator that the automatic ball machine 100 detects to trigger a ball 101 launch may be based on a gesture or movement of the player. The gesture may be customizable through the controller and may include, for example, a hand gesture of the player.

In at least one configuration, the controller 110 may include a regenerative charging circuit. The controller 110 may perform dynamic braking, via the regenerative charging circuit, of the spinner wheels 132*a*, 132*b*, 132*c* to rapidly change their speeds to exact RPMs. Typical ball machines will coast when a player changes its dial settings, e.g., if the typical ball machine goes from a speed of 100% to 50% it takes a very long time for the motor to "settle." In the dynamic braking process performed by the controller 110, excess kinetic energy is captured/harvested and stored in a battery 125 via the regenerative charging circuit 114. This dynamic braking process allows the controller 110 to rapidly change the speed of the first, second, third spinner motors to set exact speeds to hit desired ball 101 flight paths, without consuming excess electrical energy.

In at least one configuration, the automatic ball machine 100 may further include a microphone (not illustrated) that allows the automatic ball machine 100 to be controlled by verbal commands. The controller 110 may receive sound data from the microphone and convert that sound data into the verbal commands. For example, when the player is getting a lesson, the automatic ball machine 100 may be easily started and stopped to allow the player to get instruction(s). Typically, this may be done with a phone app, but using a phone app is inconvenient in that the phone must be carried while training. The automatic ball machine 100 makes this process more convenient, for example the player could say "Volley Stop" or "Volley Start". In at least one configuration, the automatic ball machine 100 may be "named" by the player, such that a plurality of automatic ball machines 100 may be differentiated when players give commands. For example, the automatic ball machine 100 could be named after actual tennis players, such as Williams, Sampras, Djokovic, or any other actual tennis player. In at least one configuration, the automatic ball machine 100 may establish a data connection between a player device (e.g., phone, headset, etc.) to improve accuracy of perceived commands given to the automatic ball machine 100 from the player device. This would prevent triggering another machine ball 100 on an adjacent court.

In at least one configuration, the automatic ball machine 100 may communicate with another ball machine 100. For example, a plurality of automatic ball machines 100 may be placed on the playing surface to get a more realistic training experience. The automatic ball machines 100 may communicate and coordinate with each other to determine which specific ball machine 100 will respond to a particular ball 101 being hit toward the automatic ball machines 100. For example, several machines 100 may be placed on the playing surface (e.g., three across the baseline in tennis) and when the player hits a wide shot, the automatic ball machine 100 closest will be the one to return a ball 101. This would allow the player to play a virtual match against a series of ball machines 100, and have the play be realistic.

Figure 9:
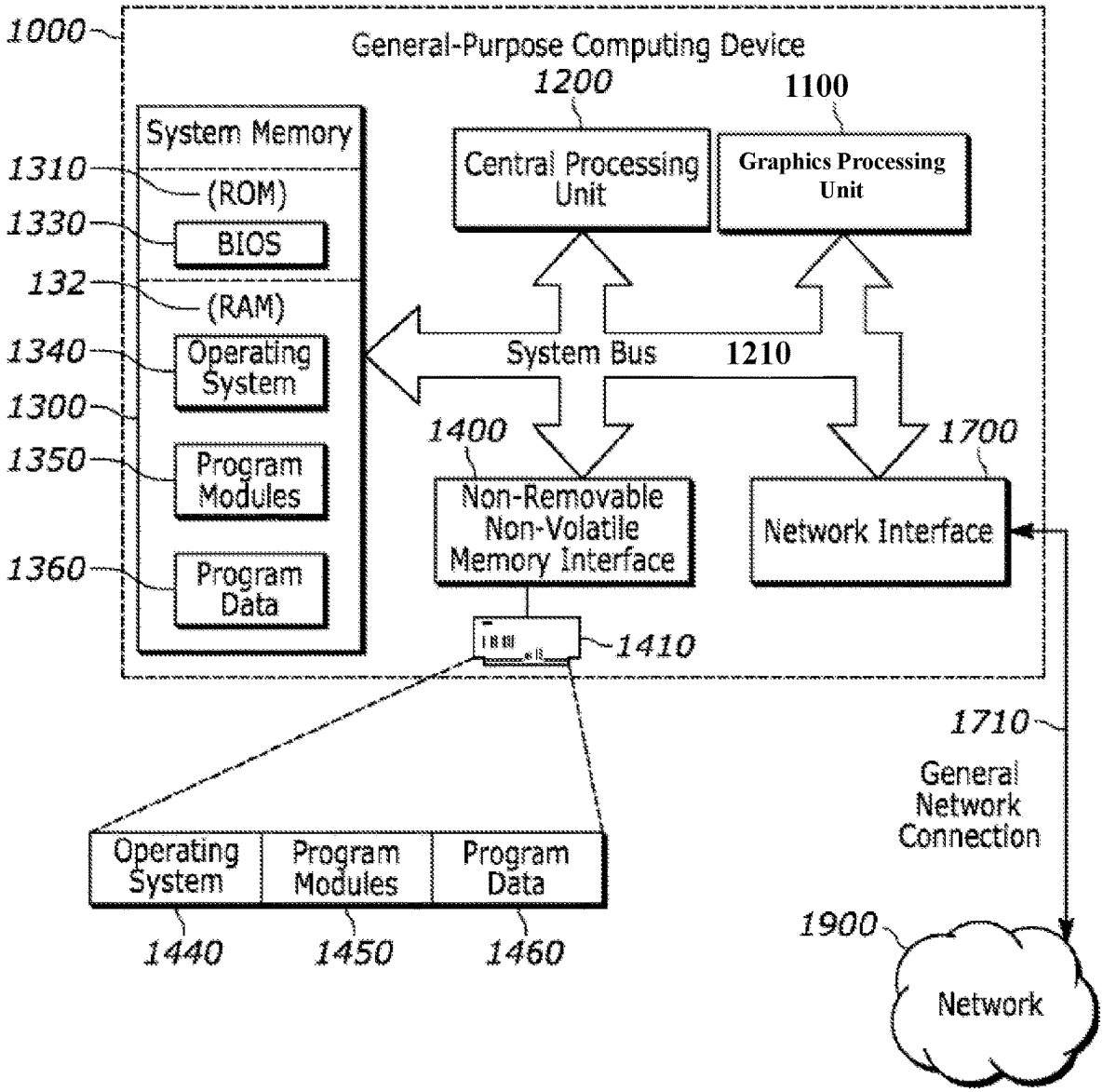
FIG. 9 illustrates an example general-purpose computing device for use with the automatic ball according to example embodiments.

With reference to FIG. 9, an exemplary general-purpose computing device is illustrated in the form of the exemplary general-purpose computing device 1000. The general-purpose computing device 1000 may be of the type utilized for the controller 110 (FIGS. 1-6) as well as the other computing devices with which the controller 110 may communicate through a communication network 1900. As such, it will be described with the understanding that variations may be made thereto. The exemplary general-purpose computing device 1000 may include, but is not limited to, one or more graphics processing units (GPUs) 1100, one or more central processing units (CPUs) 1200, a system memory 1300, such as including a Read Only Memory (ROM) 1310 to store a Basic Input/Output System (BIOS) 1330 and a Random Access Memory (RAM) 1320, and a system bus 1210 that couples various system components including the system memory to the CPU(s) 1200. The system bus 1210 may be any of several types of bus structures including a memory bus or memory controller, a peripheral bus, and a local bus using any of a variety of bus architectures. Depending on the specific physical implementation, one or more of the GPUs 1100, CPUs 1200, the system memory 1300 and other components of the general-purpose computing device 1000 may be physically co-located, such as on a single chip. In such a case, some or all of the system bus 1210 may be communicational pathways within a single chip structure.

The general-purpose computing device 1000 also typically includes computer readable media, which may include any available media that may be accessed by the general-purpose computing device 1000. By way of example, and not limitation, computer readable media may comprise computer storage media and communication media. Computer storage media includes media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which may be used to store the desired information and which may be accessed by the general-purpose computing device 1000. Communication media typically embodies computer readable instructions, data structures, program modules or other data in a modulated data signal such as a carrier wave or other transport mechanism and includes any information delivery media. By way of example, and not limitation, communication media includes wired media such as a wired network or direct-wired connection, and wireless media such as acoustic, RF, infrared and other wireless media. Combinations of any of the above should also be included within the scope of computer readable media.

When using communication media, the general-purpose computing device 1000 may operate in a networked environment via logical connections to one or more remote computers. The logical connection depicted in FIG. 9 is a general network connection 1710 to the network 1900, which may be a local area network (LAN), a wide area network (WAN) such as the Internet, or other networks. The computing device 1000 is connected to the general network connection 1710 through a network interface or adapter 1700 that is, in turn, connected to the system bus 1210. In a networked environment, program modules depicted relative to the general-purpose computing device 1000, or portions or peripherals thereof, may be stored in the memory of one or more other computing devices that are communicatively coupled to the general-purpose computing device 1000 through the general network connection 1710. It will be appreciated that the network connections shown are exemplary and other means of establishing a communications link between computing devices may be used.

The general-purpose computing device 1000 may also include other removable/non-removable, volatile/nonvolatile computer storage media. By way of example only, FIG. 9 illustrates a hard disk drive 1410 that reads from or writes to non-removable, nonvolatile media. Other removable/non-removable, volatile/nonvolatile computer storage media that may be used with the exemplary computing device include, but are not limited to, magnetic tape cassettes, flash memory cards, digital versatile disks, digital video tape, solid state RAM, solid state ROM, and the like. The hard disk drive 1410 is typically connected to the system bus 1210 through a non-removable memory interface such as interface 1400.

The drives and their associated computer storage media discussed above and illustrated in FIG. 9, provide storage of computer readable instructions, data structures, program modules and other data for the general-purpose computing device 1000. In FIG. 9, for example, hard disk drive 1410 is illustrated as storing operating system 1440, other program modules 1450, and program data 1460. Note that these components may either be the same as or different from operating system 1340, other program modules 1350 and program data 1360, stored in RAM 1320. Operating system 1440, other program modules 1450 and program data 1460 are given different numbers here to illustrate that, at a minimum, they are different copies.

With reference to FIGS. 1-6, again, the foregoing description applies to the controller 110, as well as to any other computing devices in communication with the controller 110 through the network 1900. The network interface 1700 facilitates outside communication in the form of voice and/or data. For example, the network interface 1700 may include a connection to a Plain Old Telephone Service (POTS) line, or a Voice-over-Internet Protocol (VOIP) line for voice communication. In addition, the network interface 1700 may be configured to couple into an existing network, through wireless protocols (Bluetooth, 802.11a, ac, b, g, n, or the like) or through wired (Ethernet, or the like) connections, or through other more generic network connections. In still other configurations, a cellular link may be provided for both voice and data (i.e., GSM, CDMA or other, utilizing 2G, 3G, 4G, and/or 5G data structures and the like). The network interface 1700 is not limited to any particular protocol or type of communication. It is, however, preferred that the network interface 1700 be configured to transmit data bi-directionally, through at least one mode of communication. The more robust the structure of communication, the more manners in which to avoid a failure or a sabotage with respect to communication, such as to collect healthcare information in a timely manner.

The program modules 1350 comprises a user interface which may configure the automatic ball machine 100. In many instances, the program modules 1350 comprises a keypad with a display that is connected through a wired/wireless connection with the controller 110. With the different communication protocols associated with the network interface 1700, the program modules 1350 may comprise a wireless device that communicates with the CPUs 1200 through a wireless communication protocol (i.e., Bluetooth, RF, WIFI, etc.). In other configurations, the program modules 1350 may comprise a virtual programming module in the form of software that is on, for example, a smartphone, in communication with the network interface 1700. In still other configurations, such a virtual programming module may be located in the cloud (or web based), with access thereto through any number of different computing devices. Advantageously, with such a configuration, the player may communicate with the automatic ball machine 100 remotely, with the ability to change functionality.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A ball machine comprising:

an imaging system attached to the ball machine and configured to capture image data of a playing surface of a court;

a processor configured to analyze a first frame of the image data using a neural network to detect a plurality of persons in the first frame, determine, using coordinate mapping, a coordinate position on the playing surface of each of the plurality of detected persons in the first frame, extract, from the first frame, features of each of the plurality of detected persons in the first frame, generate, using the extracted features of each of the plurality of detected persons in the first frame, a first set of feature vectors corresponding to the plurality of detected persons in the first frame, each of the first set of feature vectors being different from each other, associate a first feature vector, included in the first set of feature vectors, to the coordinate position on the playing surface of a first detected person included in the plurality of detected persons in the first frame to generate a first unique identifier, associate a second feature vector, included in the first set of feature vectors, to the coordinate position on the playing surface of a second detected person included in the plurality of detected persons in the first frame to generate a second unique identifier, and control settings of the ball machine to provide first settings based on the first unique identifier and to provide second settings based on second unique identifier, the second settings being different from the first settings; and a ball launching system configured to launch balls based on the first settings and the second settings.

2. The ball machine of claim 1, wherein the ball launching system is further configured to launch a sequence of balls, and wherein within the sequence of balls, a first subset of balls are launched based on the first settings and a second subset of balls are launched based on the second settings.

3. The ball machine of claim 1, wherein the first settings control one or more of the speed, magnitude of spin, orientation of spin, height, and slice of the balls launched, wherein the second settings further control one or more of the speed, magnitude of spin, orientation of spin, height, and slice of the balls launched, and wherein the first settings are different from the second settings.

4. The ball machine of claim 1, wherein the first settings are based on the coordinate position on the playing surface associated with the first unique identifier, and wherein the second settings are based on the coordinate position on the playing surface associated with the second unique identifier.

5. The ball machine of claim 4, wherein the first settings control a distance between the position to which launched balls are placed with respect to the playing surface and the coordinate position associated with the first unique identifier, and wherein the second settings control a distance between the position to which launched balls are placed with respect to the playing surface and the coordinate position associated with the second unique identifier.

6. The ball machine of claim 1, wherein the processor is further configured to:

analyze a second frame of the image data using the neural network to detect a plurality of persons in the second frame, determine, using coordinate mapping, a position on the playing surface of each of the plurality of detected persons in the second frame, extract, from the second frame, features of each of the plurality of detected persons in the second frame, generate, using the extracted features of each of the plurality of detected persons in the second frame, a second set of feature vectors corresponding to the plurality of detected persons in the second frame, each of the second set of feature vectors being different from each other, associate a first feature vector in the second set of feature vectors to the first unique identifier when a mathematical distance between the first feature vector included in the second set of feature vectors and the first feature vector included in the first set of feature vectors is less than a predetermined threshold, and associate a second feature vector in the second set of feature vectors to the second unique identifier when a mathematical distance between the second feature vector included in the second set of feature vectors and the second feature vector included in the first set of feature vectors is less than the predetermined threshold.

7. The ball machine of claim 6, wherein the processor is further configured to predict, based on a plurality of coordinate positions on the playing surface associated with the first unique identifier in previous frames, a future coordinate position on the playing surface that will be associated with the first unique identifier in a subsequent frame.

8. The ball machine of claim 7, wherein the first settings are based on the future coordinate position on the playing surface.

9. The ball machine of claim 1, wherein the processor is further configured to extract joint information for the detected person associated with the first unique identifier to generate a pose estimation of the first detected person associated with the first unique identifier.

10. The ball machine of claim 9, wherein the first settings are based on the pose estimation of the first detected person associated with the first unique identifier.

11. A method of operating a ball machine, the method comprising:

capturing, using an imaging system attached to the ball machine, image data of a playing surface of a court;

analyzing a first frame of the image data using a neural network to detect a plurality of persons in the first frame, determining, using coordinate mapping, a coordinate position on the playing surface of each of the plurality of detected persons in the first frame, extracting, from the first frame, features of each of the plurality of detected persons in the first frame, generating, using the extracted features of each of the plurality of detected persons in the first frame, a first set of feature vectors corresponding to the plurality of detected persons in the first frame, each of the first set of feature vectors being different from each other, associating a first feature vector, included in the first set of feature vectors, to the coordinate position on the playing surface of a first detected person included in the plurality of detected persons in the first frame to generate a first unique identifier, associating a second feature vector, included in the first set of feature vectors, to the coordinate position on the playing surface of a second detected person included in the plurality of detected persons in the first frame to generate a second unique identifier, and controlling settings of the ball machine to provide first settings based on the first unique identifier and to provide second settings based on second unique identifier, the second settings being different from the first settings; and launching balls based on the first settings and the second settings.

12. The method of claim 11, further comprises:

launching a sequence of balls, wherein within the sequence of balls, a first subset of balls are launched based on the first settings and a second subset of balls are launched based on the second settings.

13. The method of claim 11, wherein the first settings control one or more of the speed, magnitude of spin, orientation of spin, height, and slice of the balls launched, wherein the second settings further control one or more of the speed, magnitude of spin, orientation of spin, height, and slice of the balls launched, and wherein the first settings are different from the second settings.

14. The method of claim 11, wherein the first settings are based on the coordinate position on the playing surface associated with the first unique identifier, and wherein the second settings are based on the coordinate position on the playing surface associated with the second unique identifier.

15. The method of claim 14, wherein the first settings control a distance between the position to which launched balls are placed with respect to the playing surface and the coordinate position associated with the first unique identifier, and wherein the second settings control a distance between the position to which launched balls are placed with respect to the playing surface and the coordinate position associated with the second unique identifier.

16. The method of claim 11, further comprising:

analyzing a second frame of the image data using the neural network to detect a plurality of persons in the second frame, determining, using coordinate mapping, a position on the playing surface of each of the plurality of detected persons in the second frame, extracting, from the second frame, features of each of the plurality of detected persons in the second frame, generating, using the extracted features of each of the plurality of detected persons in the second frame, a second set of feature vectors corresponding to the plurality of detected persons in the second frame, each of the second set of feature vectors being different from each other, associating a first feature vector in the second set of feature vectors to the first unique identifier when a mathematical distance between the first feature vector included in the second set of feature vectors and the first feature vector included in the first set of feature vectors is less than a predetermined threshold, and associating a second feature vector in the second set of feature vectors to the second unique identifier when a mathematical distance between the second feature vector included in the second set of feature vectors and the second feature vector included in the first set of feature vectors is less than the predetermined threshold.

17. The method of claim 16, further comprising:

predicting, based on a plurality of coordinate positions on the playing surface associated with the first unique identifier in previous frames, a future coordinate position on the playing surface that will be associated with the first unique identifier in a subsequent frame.

18. The method of claim 17, wherein the first settings are based on the future coordinate position on the playing surface.

19. The method of claim 11, further comprising:

extracting joint information for the detected person associated with the first unique identifier to generate a pose estimation of the first detected person associated with the first unique identifier.

20. The method of claim 19, wherein the first settings are based on the pose estimation of the first detected person associated with the first unique identifier.

* * * * *